United States Patent [19]

Eksell et al.

[11] Patent Number: 4,870,726

[45] Date of Patent: Oct. 3, 1989

[54] SEAT BELT BUCKLE

[75] Inventors: Erik L. Eksell, Boras; Artur L. Haglund, Vargarda, both of Sweden

[73] Assignee: Allied Engineering Company S.A., Luxembourg, Luxembourg

[21] Appl. No.: 96,585

[22] Filed: Sep. 15, 1987

[30] Foreign Application Priority Data

Sep. 16, 1986 [GB] United Kingdom ..... 8622312

[51] Int. Cl.[4] ..... A44B 11/26

[52] U.S. Cl. ..... 24/636; 24/641; 24/643; 24/639

[58] Field of Search ..... 24/636, 631, 632, 633, 24/635, 637, 639-643, 647, 651

[56] References Cited

U.S. PATENT DOCUMENTS

| | | | |
|---|---|---|---|
| 4,454,634 | 6/1984 | Haglund et al. | 24/636 |
| 4,527,317 | 7/1985 | Straszewski et al. | 24/637 X |
| 4,624,034 | 11/1986 | Ushiguro et al. | 24/641 |
| 4,642,857 | 2/1987 | Ono | 24/643 X |
| 4,670,952 | 6/1987 | Ishiguro | 24/636 X |

FOREIGN PATENT DOCUMENTS

| | | | |
|---|---|---|---|
| 786012 | 5/1968 | Canada | 24/639 |
| 40132 | 11/1981 | European Pat. Off. | 24/641 |
| 98726 | 1/1984 | European Pat. Off. | 24/633 |
| 0212507 | 8/1986 | European Pat. Off. . | |
| 2250173 | 4/1973 | Fed. Rep. of Germany | 24/639 |
| 2651115 | 5/1978 | Fed. Rep. of Germany | 24/642 |
| 8700735 | 2/1987 | PCT Int'l Appl. . | |
| 8700736 | 2/1987 | PCT Int'l Appl. . | |
| 2027790 | 2/1980 | United Kingdom | 24/641 |

*Primary Examiner*—Kenneth J. Dorner
*Assistant Examiner*—Laurie K. Cranmer
*Attorney, Agent, or Firm*—Spencer & Frank

[57] ABSTRACT

A safety belt buckle has a slider having first and also second parts each adapted to engage and retain a locking member in a locking condition in which it engages a tongue inserted in the buckle. The slider is spring biassed to a position in which one part engages and retains the locking member and is movable against the spring bias to a second position to permit the locking member to move to release the tongue. The arrangement is such that if the buckle is subjected to a severe force, which moves the slider against the spring bias, the slider moves to a third position in which the second part engages and retains the locking member in the locking position.

10 Claims, 4 Drawing Sheets

SEAT BELT BUCKLE

BACKGROUND TO THE INVENTION

Field of the Invention

THE PRESENT INVENTION relates to a seat belt buckle and more particularly the invention relates to a seat belt buckle of the type intended for use in a motor vehicle. A typical buckle of this type receives a tongue which is mounted on the seat belt.

It has been found, with various buckles, in motor vehicles, that under certain circumstances the buckle may be subjected to an extremely high G force axially of the buckle, thus tending to move some of the components within the buckle against any spring force retaining the components in place. This high G force may be created if the buckle is rotated about an axis which is spaced from the buckle. Thus, under such circumstances the tongue may become released from the buckle, which is clearly undesirable. Various proposals have been made to overcome this defect, but certain of the proposals have been such that if the buckle is subjected to a rotation about a vertical axis passing through the buckle, this can lead to an inadvertent release of the tongue from the buckle.

It occasionally happens that when a motor vehicle is involved in an accident, a passenger, retained in the vehicle by the seat belt is in such a position that the seat belt is under tension. For example the vehicle may be upside down, and the person retained by the seat belt may eventually be suspended by the seat belt. In such a situation the tongue inserted into the buckle of the seat belt arrangement is subjected to a large force tending to withdraw the tongue from the buckle. The tongue is engaged by a locking member within the buckle, and if the design of the locking member is such that the locking member is drawn further towards the locking position by the force applied to the locking member from the tongue, then it may be difficult to release the seat belt from its buckle, and it will then be necessary to cut the seat belt to release the trapped person from the motor vehicle.

OBJECT OF THE INVENTION

The present invention seeks to provide an improved buckle.

SUMMARY OF THE INVENTION

According to one aspect of this invention there is provided a buckle for use with a safety belt to receive and retain a tongue present on the safety belt said buckle comprising a locking member movable between a release position, in which the locking member does not engage the tongue, and a locking position in which the locking member engages said tongue to retain the tongue in the buckle, the buckle further incorporating a slider member, the slider member having first means to engage and retain said locking member in the locking position when the slider is in a first position, and second means to engage and retain said locking member, the slider member being spring biassed to the first position, and movable against the spring bias to a second position to permit the locking member to move to the release position, the arrangement being such that if the buckle is subjected to a severe force which moves the slider against the spring bias the slider moves to a third position in which the said second means engage and retain the locking member in the locking condition.

Thus, in a preferred embodiment, if the buckle is subjected to a severe force which moves the slider, against the bias, out of the first position in which the locking bar is retained in the locking position, the slider will move to another position in which the locking bar is retained in the locking condition. Of course, if the applied force tends to move the slider in the opposite direction, i.e. in the same direction as the spring bias, the slider stays in the position in which it retains the locking member in the locking condition. Thus, regardless of the direction of the applied force the locking bar is maintained in the locking condition.

Preferably additional means are provided on the buckle which engage and retain the locking member in the locking position when the slider moves from said first position to said third position when the buckle is subjected to said severe force. Thus there is no possibility of the locking bar leaving the locking position when the buckle is subjected to a large force.

Preferably the buckle comprises a push button, manually operable to release the tongue, the push button being associated with a force transmitting member linked to said slider, the additional means being formed on said force transmitting member.

Conveniently the push button is biassed to a forward position in which the force transmitting member has said additional means located to retain the locking member in the locking position, the push button being movable against the bias, thus moving the said additional means away from the locking member and also moving slider to said second position. Thus, when the push button is operated all the features which retain the locking member in the locking condition are moved away from the locking member, thus permitting the locking member to leave the locking condition. Preferably one or more lifter members are provided, the or each lifter member engaging an end portion of the locking member, the or each lifter member being adapted to rotate to lift the locking bar into the release position when the button is pressed.

Conveniently the force transmitting member is connected to a transverse pin received in a slot extending through the slider, spring means engaging the pin and the slider so that when the button is pressed the pin moves to compress the spring and thus provides a force to bias the slider.

Advantageously the pin passes through an arcuate slot in the or each lifter so that movement of the pin on pressing the button causes the lifter or lifters to rotate to lift the locking bar into the release condition.

Preferably the push button is pivotally mounted on said buckle.

Conveniently the buckle comprises a channel having a base and two upstanding side walls, the locking member comprising an elongate locking bar the ends of which are received in apertures formed in said side walls.

Preferably the buckle incorporates a spring biassed ejector to eject the tongue, the spring biassing the ejector engaging the slider.

According to another aspect of this invention there is provided a buckle for use with a safety belt to receive and retain a tongue present on the safety belt, said buckle defining a mouth to receive the tongue, on a mechanism to retain the tongue, and a button movable to actuate the mechanism to release the tongue, the button being pivotally mounted on the buckle, the axis of pivoting being adjacent said mouth.

Preferably the mouth is at least partly defined by a recess or aperture formed in said button.

Conveniently the buckle is provided with a spring biassed ejector to eject the tongue from the buckle, the ejector substantially sealing the open mouth of the buckle when the tongue has been ejected therefrom.

BRIEF DESCRIPTION OF THE DRAWINGS

In order that the invention may be more readily understood, and so that further features thereof may be appreciated, the invention will now be described, by way of example, with reference to the accompanying drawings in which.

DESCRIPTION OF THE PREFERRED EMBODIMENTS

Figure 1:
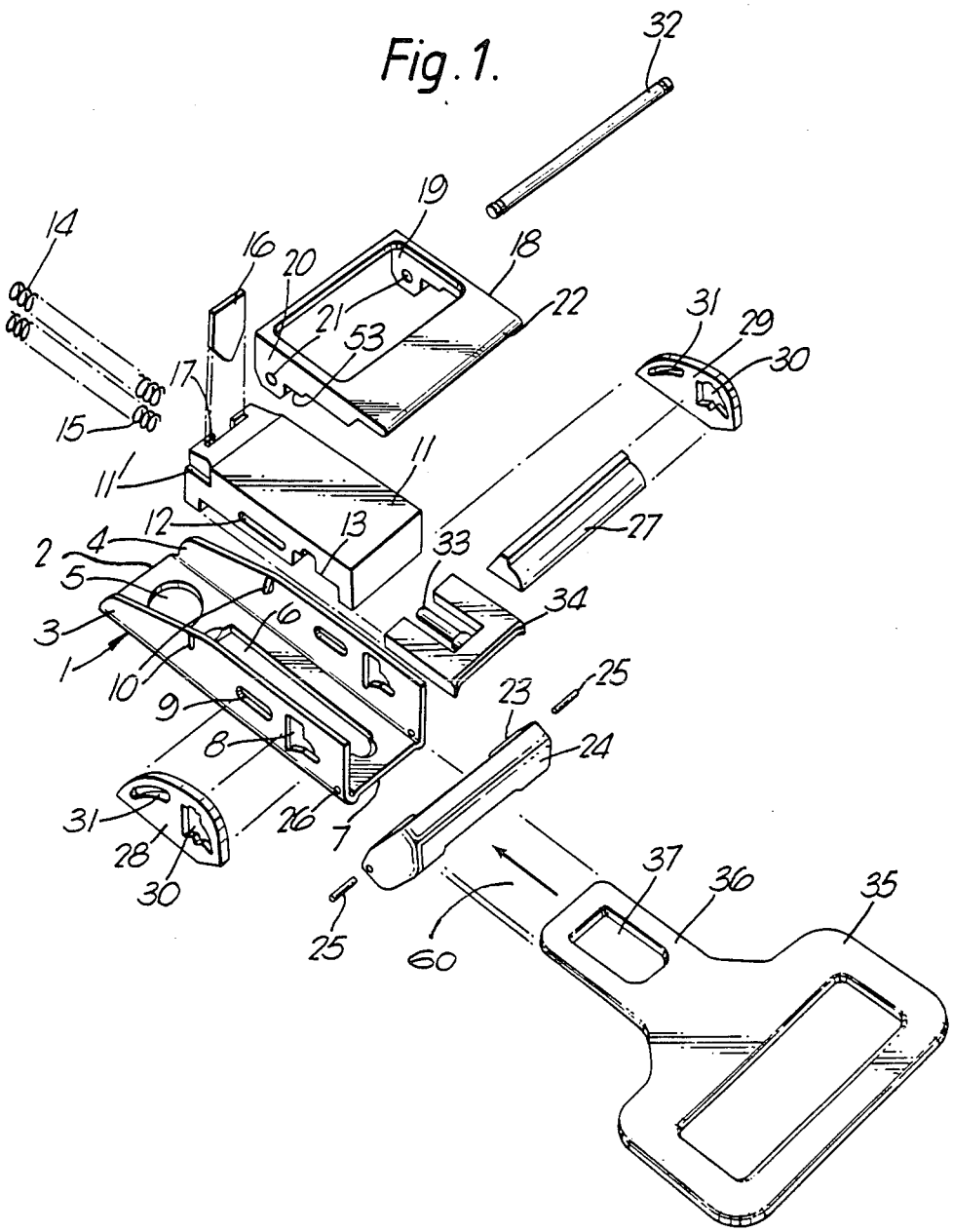
FIG. 1 is an exploded view of a buckle in accordance with the invention.

Referring initially to FIG. 1, a buckle in accordance with the invention comprises a main channel 1. The channel comprises a rectangular base 2 and two upstanding side walls 3, 4 on the two longer opposed sides of the base. The base of the channel is provided, adjacent the rear end, with an aperture 5 by means of which the channel can be securely connected to a strap or the like to connect the channel to an anchor point in a motor car or the like. The channel is also provided with an axial elongate slot 6 formed in the base 2 of the channel, located towards the front end of the channel. Each side wall of the channel defines, towards the front end 7 of the channel, a shaped aperture 8, the apertures having the same configuration and orientation in the two side walls 3 and 4. Each side wall also defines, adjacent the mid-point of the channel, a horizontal slot 9 which is parallel with the base of the channel and an inwardly directed stop or detent 10.

A slider member 11 is mounted for sliding movement within the channel. As will become apparent hereinafter, the slider may move between a forwardmost and a rearmost position.

The slider defines a horizontal transverse slot 12 which corresponds in shape with the slots 9 formed in the side walls 3 and 4 of the channel. The slot 12 extends right through the slider 11. At its front end the underside of the slider defines a contoured portion 13 which will be described hereinafter in greater detail. The slider also has formed in it two horizontally extending axial bores 38, 39 located on the centre line of the slider 11 but at different heights relative to the base 2 of the channel 1. The bores 38, 39, receive helical compression springs 14, 15, the springs being retained in position by means of a slidable panel 16 which is slidably inserted into an appropriate guide slot 17 formed on the rear face of the slider 11.

Located above the slider 11 is a force transmitting member 18. The force transmitting member defines two depending lugs 19, 20 which depend adjacent the exterior surfaces of the side walls 3 and 4 of the channel 1. The lugs 19, 20 each define a circular aperture 21.

The leading edge 22 of the force transmitting member engages the rear face 23 of a pivotal operating button 24. The pivotal operating button 24, which also serves to define the open mouth of the buckle which receives a tongue, is pivotally connected to the channel 1 by means of pivot pins 25 which engage the button 24 and also engage in small apertures 26 formed in the side wall 3 and 4 of the channel adjacent the front end 7 of the channel. Thus the pivotal axis of the button 24 is very close to the open mouth of the buckle and when the button 24 moves pivotally the part defining the mouth of the buckle does not move significantly.

A locking bar 27 is provided. The locking bar is an elongate metal bar which extends transversely of the channel 1, the ends of the locking bar extending through the apertures 8 formed in the side walls 3 and 4 of the channel. The locking bar has a particular configuration which will be described hereinafer, but the locking bar can move roatationally within the apertures 8, to a limited extent. The two opposed ends of the locking bar project beyond the side walls 3 and 4 of the channel and engaging with the projecting ends of the locking bar are two lifter members 28, 29. Each lifter member has an aperture 30, having a configuration substantially the same as the configurations of the cross section of the locking bar 27. The ends of the locking bar 27 are inserted into the apertures 30. The lifter members are thus engaged with the locking bar by means of these apertures 30 and rotation of the lifter members serves to rotate the locking bar 27. Each lifter member also defines an arcuate slot 31, located adjacent the aperture 30.

A pin 32 is provided which extends through the apertures 21 formed in the lugs 19 present on the force transmitting member 18, through the arcuate slots 31 in the lifters, through the elongate horizontal slots 9 formed in the side walls of the channel, and through the elongate horizontal slot 12 formed in the slider 11. The spring 14 contained within the upper horizontal bore formed within the slider is retained in compression between the slidable panel 16 and the pin 32. Thus the pin 32 is biassed to a forwardmost position within the elongate slot 12, thus forcing the force transmitting member 18 to a forwardmost position, thus causing the operating button 24 to be pivoted as far as possible away from the channel 1.

The effect of the spring 14 is also to bias the slider member 11 towards a rear position.

The second spring 15 contained within the slider 11 engages a spigot 33 formed on an ejector member 34. Part of the spring 15 and the spigot 33 are accommodated within the elongate slot 6 formed in the base of the channel, and the ejector member slides along the base of the channel. The spring 15 biasses the ejector member towards the front end of the channel and also assists in biassing the slider towards the rear of the channel.

The rear of the slider member 11 is contoured to define two shoulders 11'. The shoulders 11' are configured to lie under the stops or detents 10, and thus the slider member is prevented from tilting upwardly out of the channel.

The buckle, as illustrated, is intended to receive a plate 35 having a tongue 36 defining a single aperture 37.

Figure 2:
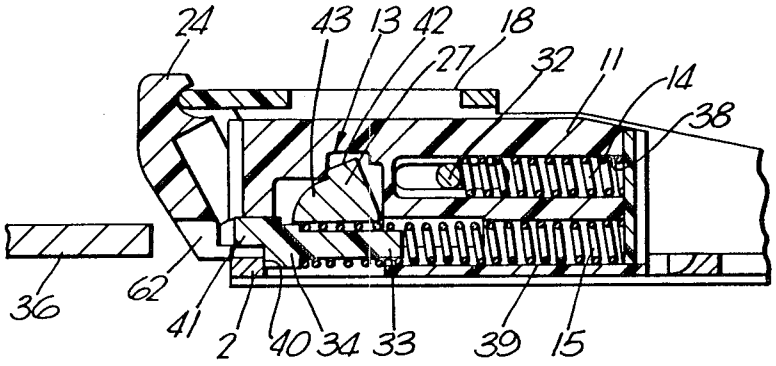
FIG. 2 is a sectional view through part of the buckle when in the released condition.

Referring now to FIG. 2, part of the buckle is shown in the released condition.

It is to be observed that the spring 14 is contained within an axial bore 38 formed within the slider member 11, and the spring 15 is received within a similar bore 39. The bore 39 is formed in a downwardly projecting part of the slider 11 that is received in the slot 6 formed in the base of the channel. The buckle defines a path 60, commencing with the open mouth of the buckle defined by the operating button 24, along which the tongue 36 may be introduced into the buckle. The path 60 lies in a plane which is substantially parallel to and located immediately above the base 2 of the main channel 1.

The spring 14 exerts a force upon the pin 32, the force biassing the pin 32 towards the left as shown in FIG. 2. The force is transferred by the pin 32 to the force transmitting member 18 and thus to the operating button 24 which is thus pivoted to a position as illustrated. The spring 14 also exerts a force upon the slider member 11 biassing the slider towards the right as shown in FIG. 2. The slider member 11 thus moves towards the right. The spring 15 exerts a force upon the ejector 34 biassing the ejector towards the left of FIG. 2, and the ejector is thus moved to a leftward most position in which the forward end 40 of the spigot 33 engages the front end of the elongate slot 6, part of the ejector 41 then extending through the open mouth 62 of the buckle which is defined by an aperture formed in the pivoting operating button 24. The ejector and the button 24 co-operate to seal or close substantially the open mouth of the buckle, thus minimising the risk of any foreign objects falling into the interior of the buckle. The mouth 62 defined by the aperture is such that the tongue 36 may be inserted into the buckle, and it will be understood that as the tongue enters the buckle the ejector is engaged by the front end of the tongue 36 and moves rearwardly.

The locking bar 27 is shown in an elevated position. The locking bar 27 is maintained in this position by the ejector, which is located under the locking bar.

Figure 3:
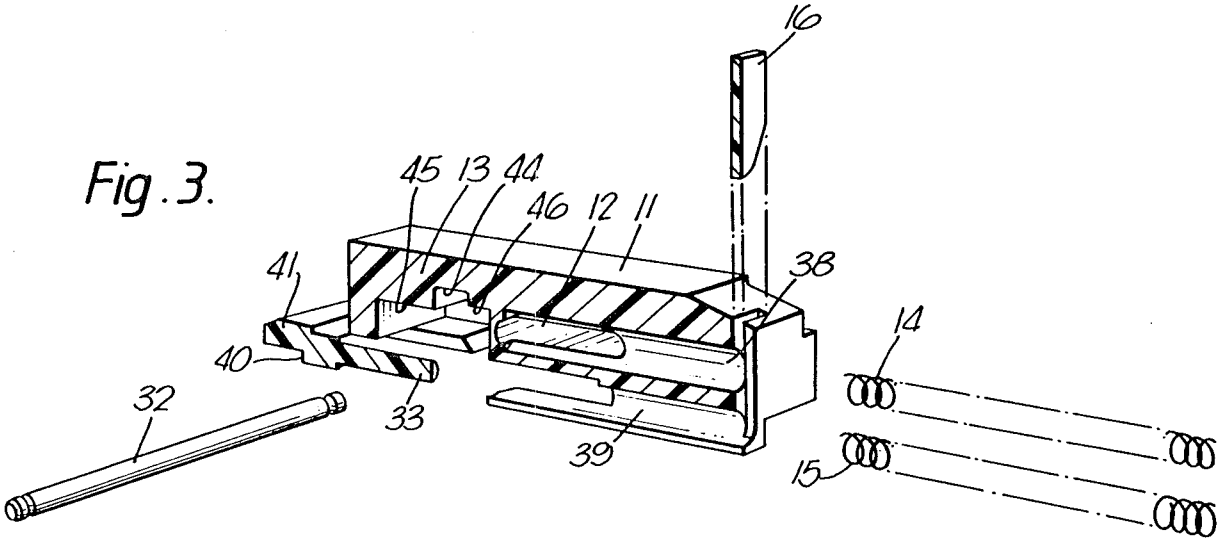
FIG. 3 is a perspective exploded partsectional view of the slider and the ejector of the buckle of FIG. 1.

The structure of the slider member can be more clearly seen in FIG. 3. The contoured part of the slider member 13 is designed to cooperate with the locking bar 27. The locking bar 27 is of generally sector-shaped cross section and defines, on its upper surface, a substantially square projection 42, adjacent which is located an arcuate portion 43. The contoured portion of the slider 11 defines a central upwardly extending recess 44 dimensioned to receive the projection 42 of the locking bar when the locking bar is in the retracted position illustrated in FIG. 2. The recess 44 has a greater width than the width of the projection 42. Towards the front of the slider the countour portion defines a surface 45 at a level lower than the top of the recess 44, and to the rear of the buckle, that is to say to the right of the recess 44 as shown in FIGS. 2 and 3 there is a further surface 46 defined by the slider which is at a level higher than the level 45 but lower than the level of the top of the recess 44.

Figure 4:
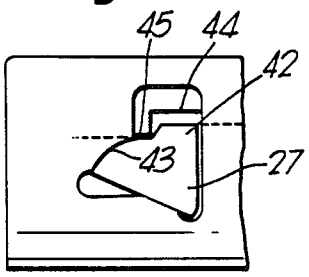
FIG. 4 is a side view of the channel of the buckle of FIG. 1 showing the locking bar in the position that it occupies when in the normal locked position.

When the buckle is in the latching condition, as shown in FIG. 4, the locking bar 27 is in a tilted condition, but the projection 42 still projects substantially upwardly and is received within the recess 44. The step on the slider between the surfaces 44 and 45 is located adjacent the projection 42, thus preventing the locking bar rotating in an anti-clockwise direction to the release condition.

When in the latching condition the slider 11 is biassed to the right as shown in FIG. 4. However the portion of the slider 11 between the surfaces 44 and 45 engages the projection 42, and the locking bar itself engages the right hand side of the aperture 8 in the side wall of the channel, thus preventing the slider 11 moving towards the right from the illustrated position.

Figure 5:
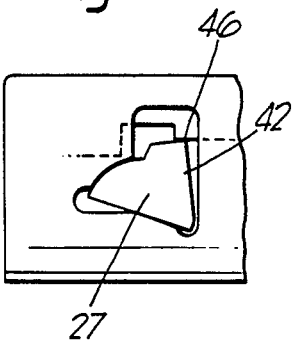
FIG. 5 is a view corresponding to FIG. 4 showing the locking bar when in the locked position, when the buckle is subjected to a severe axial G force.
Figure 9:
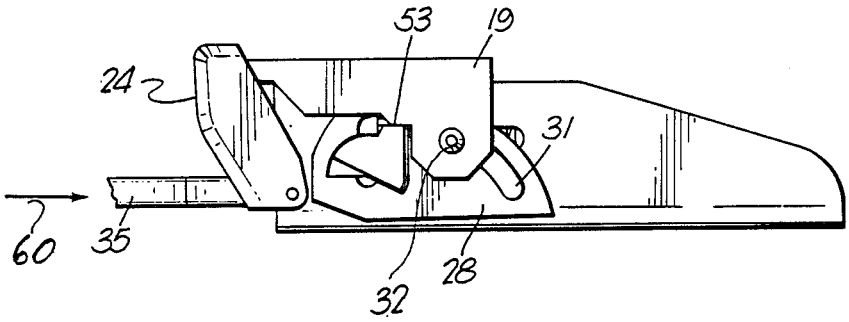
FIG. 9 is a side view of the operative parts of the buckle when in the latched condition.

It is to be understood that the slider 11 may be subjected to forces tending to move the slider against the bias imparted thereto by the springs 14 and 15, particualarly if the buckle is subjected to severe force. If the buckle is subjected to a G force tending to move the slider towards the right as shown in FIG. 4, the slider cannot move in that direction since the step defined between the surface 45 and the recess 44 formed in the slider engages the projection 42 formed on the locking bar, thus preventing movement of the slider, and also locks the locking bar. If, however, the buckle is subjected to a severe G-force tending to move the slider towards the left as shown in FIG. 4, then the slider may move in this direction. The recess 44 will, of course, become aligned with the projection 42 on the locking bar 27 during this movement of the slider. However the locking bar cannot move to the release position since the force transmitting member 18 has, on its lugs 19, stop surfaces 53 which, as shown in FIG. 9, lie immediately over the locking bar 27 when the buckle is in the latching condition, thus preventing the locking bar 27 from moving up out of the latching position. When the slider has moved fully to the left it will then adopt the position illustrated in FIG. 5, with the surface 46 in engagement with the top of the projection 42 formed on the locking bar 27, thus again preventing the locking bar from emerging from the locking position.

Thus, in the buckle described, even if the buckle is subjected to a high G-force and the slider moves, the tongue will not be released from the buckle.

Of course, if the buckle is subjected to a rotational force about the axis of the slider, the slider will not tend to move, since the slider is a one-piece component, and a rotational force about the axis of the buckle will therefore not tend to impart any axial motion to the slider.

Figure 6:
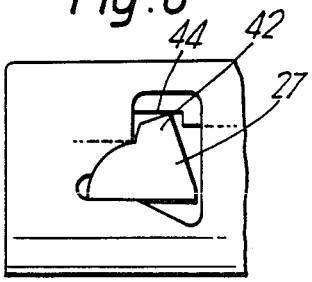
FIG. 6 shows the locking bar in the normal released position.

FIG. 6 illustrates the position of the locking bar when the buckle is in the released condition, and it can be seen that the projection 42 is received within the recess 44. The locking bar, as can be seen from FIGS. 7 and 8, in addition to having the upstanding projection 42 and the arcuate portion 43 has two converging walls, namely a front wall 47 and a rear wall 48, the walls converging towards a point 49. In the region of the point 49 the front wall 47 is curved towards the rear wall 48 thus defining an arcuate portion 49. The radius of curvature of the arcuate portion is such that the centre of curvature 50 of the arcuate portion is located at a point between the front wall 47 and the rear wall 48, as can be seen from FIG. 8. The centre of curvature 50 may also be the centre of curvature of the arcuate wall 43.

Figure 7:
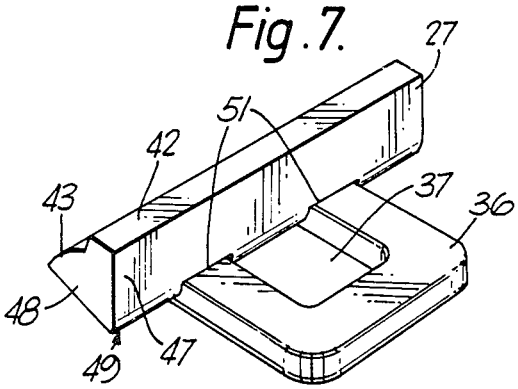
FIG. 7 is a perspective view showing how the locking bar and the tongue cooperate.
Figure 8:
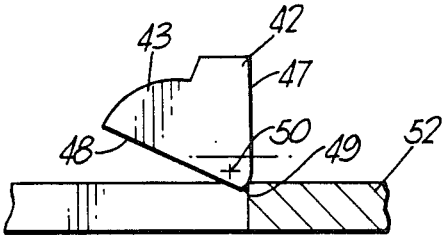
FIG. 8 is a vertical sectional view showing the engagement between the locking bar and the tongue.

The lower point 49 of the locking bar 27 is provided with two recesses 51 as can be seen in FIG. 7 to enable the locking bar to be braought into engagement with the locking tongue 36 and its aperture 37. It will thus be appreciated that when the tongue 35 is inserted into the buckle the locking bar is lowered, with the recesses 51 in alignment with the parts of the tongue 36 adjacent the aperture 37, and then the point 49 of the locking bar 27 is inserted partially into the aperture 37. The tongue is then slightly withdrawn from the buckle so that the part of the tongue 52 shown in FIG. 8 engages the point 49 of the locking bar 27. The tongue is retained in this position by the biassing force applied to the tongue by the ejector 34. It can be seen that the actual part of the tongue 52 that engages the locking bar engages on the arcuate portion 49. However, when the buckle is in the locking condition the locking bar 27 cannot move upwardly, and thus the tongue is retained in position. However, any force applied to the tongue tending to withdraw the tongue from the buckle will impart a force on the locking bar which is primarily transferred to the channel 1 by the engagement of the arcuate portion 43 of the locking bar with the corresponding arcuate part of the apertures 8. The force may generate a vertical component which effectively provides an upward force on the locking bar 27. This may tend to move the locking bar 27 upwardly so that the locking bar is brought into engagement with the slider which will normally be in the position illustrated in FIG. 4, but which may be in the condition illustrated in FIG. 5. It will thus be understood that the locking bar remains in the locking condition.

If a person is using the seat belt and is suspended from the seat belt, if it is possible to move the button, thuis moving the slider to the release position then the locking bar will tend to move out of the locking position under the force applied to the locking bar via the tongue as a consequence of the design of the interconnection between the tongue and the locking bar.

The locking bar is moved between the locking position and the retracted position by means of the lifters 28 and 29 which are mounted on the ends of the locking bar which project beyond the side walls 3 and 4 of the channel. The lifters are caused to move in a pivotal sense, when the operating button 24 is pressed, since movement of the operating button 24 causes movement of the force transmitting member 18 and a consequent movement of the pin 32 against the bias of the spring 14.

The operating button 24 is pivotally connected to the side walls 3, 4 of the main channel 1 about a pivoting axis which extends transversely of the channel 1 substantially in the plane defined by the path 60 to be followed by the tongue 36 as it is introduced into the buckle. An operative face of the operating button 24 initially extends substantially perpendicularly to that plane. The operating button 24 may be moved pivotally with the operating face moving generally in a direction parallel to the plane. Thus, in the described embodiment of the invention, the operating button 24 effectively forms the end of the buckle through which the tongue 36 of the plate 35 is introduced into the buckle. To operate the button 24, a pressure is applied thereto in a sense which is parallel to the direction is insertion of the tongue 36 into the buckle.

Figure 10:
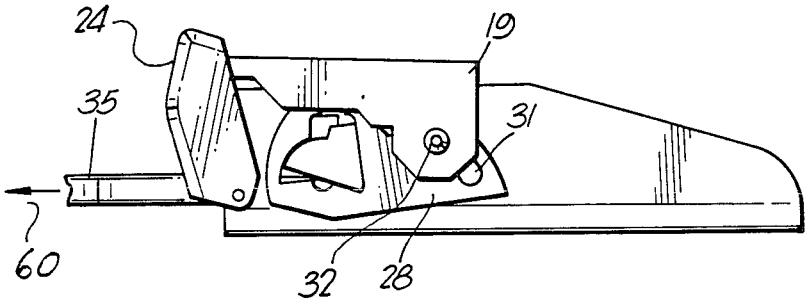
FIG. 10 is a view corresponding to FIG. 9 showing the situation that exists when the release button has been partially pressed.
Figure 11:
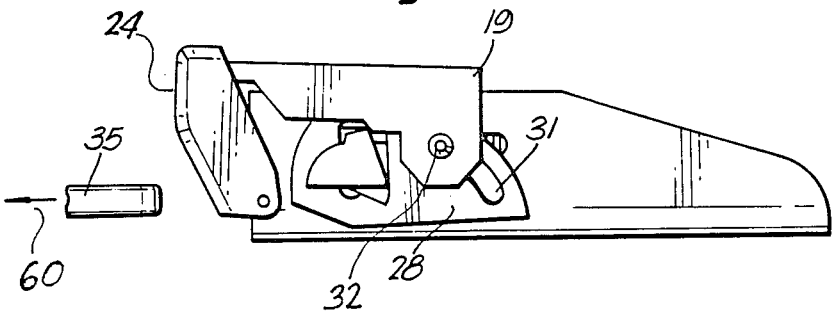
FIG. 11 is a view corresponding to FIGS. 9 and 10 showing the condition of the buckle when the tongue has been released from the buckle.

FIG. 9 illustrates the buckle in its locked condition. It can be seen that the pin 32 is located towards the left hand end of the arcuate slot 31 present in the lifter 28. As the operating button 24 is depressed, as shown in FIG. 10, the pin 32 moves towards the right, and thus moves along the arcuate slot 31, thus causing the lifter 28 to rotate, as shown in FIG. 10. The lifter 29 operates in a similar manner. As the lifters rotate, so the locking bar 27 is rotated and the point 49 of the locking bar is moved out of engagement with the portion 52 of the tongue 35. The ejector then moves towards the left under the force imparted thereto by the spring 15, thus ejecting the tongue 35 from the buckle as shown in FIG. 11. When the tongue has been ejected from the buckle, the ejector is located underneath the locking bar 27, thus preventing the locking bar from moving back to the locking position. However, the operating button 24 returns to a forward position as shown in FIG. 11.

In order to latch the buckle the tongue 36 is merely inserted into the buckle, thus forcing the ejector and thus the slider via the springs, rearwardly. As the aperture 37 in the tongue 36 passes under the locking bar 27, the locking bar is caused to rotate to the locking position. This rotation is effected by the engagement of the step between the surface 45 and the recess 44 on the slider engaging the upstanding portion 42 present on the locking bar 27. The slider is biassed to move to the left as shown in the figures by the action of spring 14, and thus the step between the surface 45 and the recess 44 will engage initially the arcuate portion 43 of the locking bar and subsequently the projecting portion 42, thus causing the locking bar to rotate in a clockwise direction as shown in FIG. 4, thus causing the locking bar again to enter the locked condition as shown in FIG. 9.

Whilst the invention has been described with reference to one particular embodiment in which the tongue 36 defines a central aperture 37, it is to be appreciated that in a modified embodiment of the invention, the buckle may be designed to receive a tongue of the type that has a single stem and an enlarged head, in which case only one central recess 51 will be provided in the pointed end 49 of the locking bar 27.

Many modifications will suggest themselves to those skilled in the relevant art.

What is claimed is:

1. A buckle for use with a safety belt to receive and retain a tongue present on the safety belt said buckle comprising a locking member does not engage the tongue, and a locking position in which the locking member engages said tongue to retain the tongue in the buckle, the buckle further incorporating a slider member, the slider member having first means to engage and retain said locking member in the locking position when the slider is in a first position, and second means to engage and retain said locking member, the slider member being spring biassed to the first position, and movable against the spring bias to a second position to permit the locking member to move to the release position, the arrangement being such that if the buckle is subjected to a severe force which moves the slider against the spring bias the slider moves to a third position in which the said second means engage and retain the locking member in the locking condition.

2. A buckle according to claim 1 wherein additional means are provided on the buckle which engage and retain the locking member in the locking position when the slider moves from said first position to said third position when the buckle is subjected to said severe force.

3. A buckle according to claim 2 wherein the buckle comprises a push button, manually operable to release the tongue, the push button being associated with a force transmitting member linked to said slider, the said additional means being formed on said force transmitting member.

4. A buckle according to claim 3 wherein the push button is biassed to a forward position in which the force transmitting member has said additional means located to retain the locking member in the locking position, the push button being movable against the bias, thus moving said additional means away from the locking member and also moving the slider to said second position.

5. A buckle according to claim 4 wherein one or more lifter members are provided, the or each lifter member engaging an end portion of the locking member, the or each lifter member being adapted to rotate to lift the locking bar into the release position when the button is pressed.

6. A buckle according to claim 5 wherein the force transmitting member is connected to a transverse pin received in a slot extending through the slider, spring means engaging the pin and the slider so that when the button is pressed the pin moves to compress the spring and thus provides a force to bias the slider.

7. A buckle according to claim 6 wherein the pin passes through an arcuate slot in the or each lifter so that movement of the pin on pressing the button causes the lifter or lifters to rotate to lift the locking bar into the release condition.

8. A buckle according to claim 3 wherein the push button is pivotally mounted on said buckle.

9. A buckle according to claim 1 wherein the buckle comprises a channel having a base and two upstanding side walls, the locking member comprising an elongate locking bar the ends of which are received in apertures formed in said side walls.

10. A buckle according to claim 1 wherein the buckle incorporates a spring biassed ejector to eject the tongue, the spring biassing the ejector engaging the slider.

* * * * *